US008876310B2

(12) United States Patent
Nozaki et al.

(10) Patent No.: US 8,876,310 B2
(45) Date of Patent: Nov. 4, 2014

(54) OPERATION DEVICE

(75) Inventors: Makoto Nozaki, Yokkaichi (JP); Hirokatsu Nakajima, Yokkaichi (JP)

(73) Assignee: Sumitomo Wiring Systems, Ltd., Mie (JP)

( * ) Notice: Subject to any disclaimer, the term of this patent is extended or adjusted under 35 U.S.C. 154(b) by 317 days.

(21) Appl. No.: 13/580,229

(22) PCT Filed: Feb. 10, 2011

(86) PCT No.: PCT/JP2011/000750

§ 371 (c)(1),
(2), (4) Date: Aug. 21, 2012

(87) PCT Pub. No.: WO2011/108196

PCT Pub. Date: Sep. 9, 2011

(65) Prior Publication Data

US 2012/0314397 A1 Dec. 13, 2012

(30) Foreign Application Priority Data

Mar. 1, 2010 (JP) ..... 2010-044084

(51) Int. Cl.
*G01D 11/28* (2006.01)
*H01H 19/02* (2006.01)

(52) U.S. Cl.
CPC ..... *H01H 19/025* (2013.01); *H01H 2219/06* (2013.01); *H01H 2219/0622* (2013.01); *H01H 2221/008* (2013.01)
USPC ..... 362/23.22

(58) Field of Classification Search
CPC ..... H01H 19/025; G04B 19/30
USPC ..... 362/23.14, 23.01, 23.22; 200/310, 316, 200/317
See application file for complete search history.

(56) References Cited

U.S. PATENT DOCUMENTS

| | | | | |
|---|---|---|---|---|
| 4,044,214 | A * | 8/1977 | Rayburn et al. | 200/316 |
| 4,853,151 | A * | 8/1989 | Vogtle et al. | 252/299.61 |
| 6,224,221 | B1 * | 5/2001 | Glienicke | 362/23 |
| 6,948,824 | B2 * | 9/2005 | Miwa | 362/26 |
| 8,425,100 | B2 * | 4/2013 | Akabori et al. | 362/551 |
| 2006/0227528 | A1 * | 10/2006 | Nakamoto et al. | 362/23 |

FOREIGN PATENT DOCUMENTS

| | | |
|---|---|---|
| DE | 102005057025 | 1/2007 |
| JP | 11-134932 | 5/1999 |
| JP | 2002-231101 | 8/2002 |
| JP | 3744799 | 2/2006 |
| JP | 2008-016332 | 1/2008 |

* cited by examiner

*Primary Examiner* — Julie Bannan
(74) *Attorney, Agent, or Firm* — Greenblum & Bernstein, P.L.C.

(57) ABSTRACT

An operation device is capable of illuminating a peripheral wall of an operation knob in a circumferential direction. The operation device includes an operation knob having a substantially cylindrical peripheral wall centering on an axis and rotating around the axis, the peripheral wall being provided with an illuminated portion in a circumferential direction; an illumination light source provided on the axis of the operation knob and emitting light frontward; and a reflector. A reflection surface is configured with a portion of a surface of the reflector provided inside the operation knob. The reflection surface has a shape extending in the circumferential direction centering on the axis of the operation knob and having a diameter increasing toward a front side such that the light emitted frontward from the illumination light source is reflected by the reflection surface toward the illuminated portion.

5 Claims, 3 Drawing Sheets

OPERATION DEVICE

TECHNICAL FIELD

The present invention relates to an operation device having an operation knob that is rotationally operated.

BACKGROUND ART

Conventionally, an operation device having a rotationally operated operation knob is provided to an instrumental panel and the like of an automobile. Rotating the operation knob changes a rotation amount of a rotary encoder and the like. According to the rotation amount, an operation object, such as air conditioner temperature and audio instrument volume, is controlled. In some cases, such an operation device is provided with an illumination light source in order to illuminate an operation knob or the like.

For example, Patent Literature 1 discloses an operation device B10 that changes and controls air conditioner temperature, as shown in FIGS. 5 and 6. The operation device B10 includes a rotary encoder B50, a fixed display B60 having a circular plate shape, an operation knob B30, an illumination light source B40, and a light guiding body B20. The operation knob B30 has a cylindrical peripheral wall B31. The operation knob B30 rotates around the fixed display B60. The operation knob B30 has a front end surface B34 extending substantially parallel to the fixed display B60. The illumination light source B40 and the light guiding body B20 are provided on a reverse side of the fixed display B60.

The fixed display B60 is provided with a display marking B62 indicating air conditioner temperature or the like. The front end surface B34 of the operation knob B30 is provided with a pointer display B36 indicating a rotation position of the operation knob B30. The light guiding body B20 guides light from the illumination light source B40 to the fixed display B60 and the front end surface B34 of the operation knob B30. The light from the illumination light source B40 illuminates the display marking B62 and the pointer display B36.

Specifically, the light guiding body B20 is provided inside the operation knob B30. The light guiding body B20 has a reversed cone shape. A through hole B20*a* is provided at a vertex of the light guiding body B20. The through hole B20*a* and the illumination light source B40 face each other. A bottom surface B20*b* of the light guiding body B20 and the pointer display B36 face each other. An interior portion B22 of a wall defining a reversed cone shape of the light guiding body B20 acts as a central light guiding path. The light from the illumination light source B40 passes through the through hole B20*a* and enters the interior portion B22 of the light guiding body B20. The interior portion B22 of the light guiding body B20 guides the light from the illumination light source B40 toward a fixed display B60 side. Further, a wall interior B24 of the light guiding body B20 acts as a side light guiding path. The wall interior B24 of the light guiding body B20 guides the light from the illumination light source B40 to the front end surface B34 of the operation knob B30.

In the operation device having the rotationally operated operation knob described above, it is desirable that the peripheral wall of the operation knob is illuminated along a circumferential direction in order to indicate a position of the operation knob or from a viewpoint of design.

As a configuration in which such illumination is performed in the operation device B10 disclosed in the Patent Literature 1, for example, a configuration may be considered in which the bottom surface B20*b* of the light guiding body B20 faces the peripheral wall B31 of the operation knob B30. In this configuration, the wall interior B24 of the light guiding body B20 guides the illumination light source B40 to the peripheral wall B31 of the operation knob B30. In this configuration, however, the light needs to pass through the wall interior B24 of the light guiding body B20. Therefore, the wall of the light guiding body B20 of this configuration becomes thick and the thick-walled light guiding body B20 is provided along the circumferential direction of the operation knob B30, which results in an increase in weight and cost.

CITATION LIST

Patent Literature

Patent Literature 1: Japanese Patent No. 3744799

SUMMARY OF INVENTION

Accordingly, an object of the present invention is to provide an operation device capable of illuminating a peripheral wall of an operation knob along a circumferential direction in a simple configuration.

Solution to Problem

In order to achieve the object, an operation device of the present invention includes an operation knob having a substantially cylindrical peripheral wall centering on an axis extending in a front-rear direction and rotating around the axis in response to a rotational operation, the peripheral wall being provided with an illuminated portion in a circumferential direction; an illumination light source provided on a rear side of the illuminated portion on an axis line of the operation knob and emitting light frontward; and a reflector provided on a front side of the illumination light source and connected to the operation knob. A surface of the reflector includes a reflection surface provided on an inner side of the peripheral wall of the operation knob and capable of reflecting the light from the illumination light source. The reflection surface has a shape extending in the circumferential direction centering on the axis line of the operation knob and having a diameter increasing toward the front side such that the light emitted frontward from the illumination light source is reflected by the reflection surface toward the illuminated portion.

According to the device, with a simple configuration including the reflector that reflects the light from the illumination light source, the illuminated portion provided on the peripheral wall of the operation knob is illuminated in the circumferential direction. Further, it is not necessary for the device to have a thick wall for the reflector that guides the light from the illumination light source to the peripheral wall of the operation knob, thereby achieving a reduction in weight of the entire device and a reduction in cost.

DESCRIPTION OF EMBODIMENTS

Preferable embodiments of the present invention are described with reference to the drawings.

Figure 1:
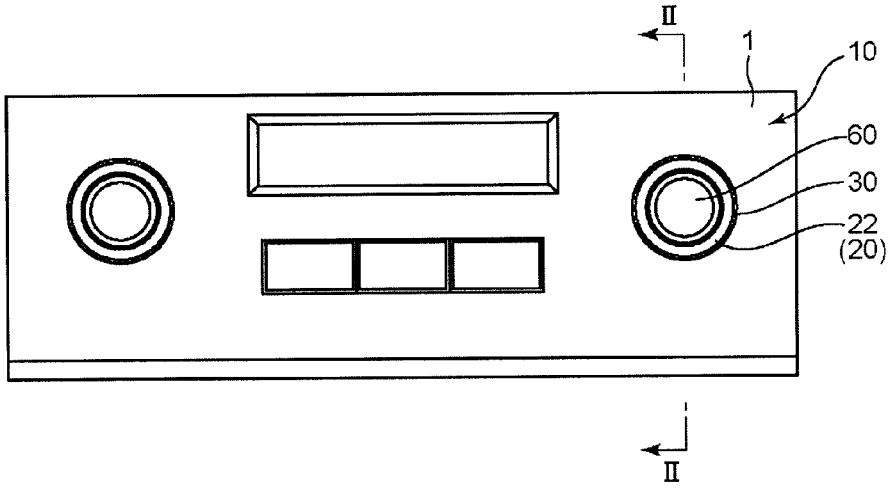
[FIG. 1] A front view showing a state in which an operation device according to the present invention is attached to a panel.
Figure 2:
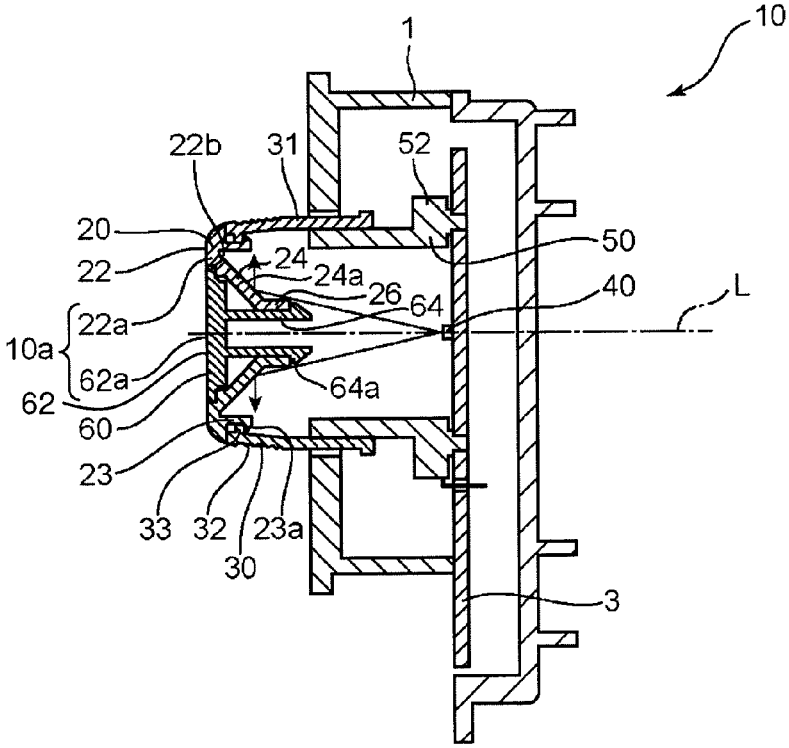
[FIG. 2] A cross-sectional view taken along a line II-II in FIG. 1.

In the present embodiment, an operation device 10 according to the present invention is used as a means to control temperature of an air conditioner. The operation device 10 is attached to a panel 1 extending in a predetermined direction. The panel 1 configures a portion of an instrumental panel of a vehicle. FIG. 1 is a schematic front view showing a state in which the operation device 10 is attached to the panel 1. FIG. 2 is a cross-sectional view taken along a line II-II in FIG. 1.

The operation device 10 includes a reflector 20, an operation knob 30, an LED (illumination light source) 40, a rotary encoder element 50, and a cover 60.

The rotary encoder element 50 includes a rotator 52 that rotates around a predetermined rotation axis and an outputter (not shown in the drawings). The outputter (not shown in the drawings) of the rotary encoder element 50 outputs a signal corresponding to a rotation angle of the rotator 52. The rotator 52 is rotatably fixated to a circuit board 3. The circuit board 3 is provided behind the panel 1, that is, a reverse side of the panel 1. The rotator 52, which is approximately parallel to the panel 1, has a substantially cylindrical shape. A central axis, that is, a rotation axis L of the rotator 52 extends in a front-rear direction, that is, in a direction orthogonal to the circuit board 3 and the panel 1.

The LED 40 illuminates an illuminated portion 32 (described later) of the operation knob 30. The LED 40 is mounted on the circuit board 3. The LED 4 is mounted along the rotation axis L of the rotator 52. The LED 40 emits light frontward, that is, toward a panel 1 side.

The operation knob 30 is rotationally operated by an occupant of a vehicle or the like. The operation knob 30 is configured with a peripheral wall 31 having a substantially cylindrical shape. The peripheral wall 31 extends in the front-rear direction centering on the rotation axis L of the rotator 52 of the rotary encoder element 50. The operation knob 30 is provided on the front side of the LED 40. The operation knob 30 is connected to the rotator 52. A front end portion of the rotator 52 is inserted into an interior of a rear side portion of the operation knob 30. The operation knob 30 is connected to the rotator 52 so as to be integrally rotatable. The operation knob 30 rotates around the rotation axis L. A front side portion of the operation knob 30 protrudes toward a front side of the panel 1. Thereby, an occupant or the like can operate the operation knob 30. When the operation knob 30 rotates around the rotation axis L in response to a rotational operation by the occupant or the like, the rotator 52 rotates accordingly. Then, a signal corresponding to the rotation angle of the rotator 52 is output from the outputter. Based on the output signal, the temperature of the air conditioner is changed.

The illuminated portion 32 which is illuminated by the LED 40 is provided to a portion of the peripheral wall 31 of the operation knob 30 protruding toward the front side of the panel 1. The illuminated portion 32 is provided along the circumferential direction of the peripheral wall 31. The illuminated portion 32 extends over an entire periphery of the peripheral wall 31. The illuminated portion 32 has a predetermined width in a direction parallel to the rotation axis L. The illuminated portion 32 is configured with a translucent material. When the illuminated portion 32 is illuminated by the LED 40, the illuminated portion 32 transmits light from the LED 40 to the exterior. Thereby, the operation knob 30 is illuminated in a ring shape.

For example, an entirety of the operation knob 30 is formed of a transparent material such as acrylic, polycarbonate, ABS, or the like. The operation knob 30 except the illuminated portion 32 is coated with a light-shielding coating material. Thereby, only the illuminated portion 32 transmits light in the operation knob 30.

A lock 33 is provided to a front end of the operation knob 30, the lock 33 protruding inward in a radial direction.

The reflector 20 guides the light from the LED 40 to the illuminated portion 32 and also serves as a decorating member of the operation device 10. The reflector 20 includes a decorative portion 22, a reflecting portion 24, and a latching portion 26. The decorative portion 22 extends in a direction orthogonal to the rotation axis L. The reflecting portion 24 extends rearward from a rear surface of the decorative portion 22. The latching portion 26 extends rearward from a rear end of the reflecting portion 24. The reflector 20 is connected to the operation knob 30. An outer peripheral edge of the decorative portion 22 in the reflector 20 is in contact with a front end of the peripheral wall 31 of the operation knob 30. The reflecting portion 24 and the latching portion 26 in the reflector 20 are housed inside of the peripheral wall 31 of the operation knob 30.

The decorative portion 22, the reflecting portion 24, and the latching portion 26 are mutually integrally formed. An entire surface of the reflector 20, which is integrally formed of the portions 22, 24, and 26, is plated. A plating-material coating the surface of the reflector 20 has a light reflection property. It is preferable that the plating-material has an excellent decorative property, by further having glossy finish and the like. In the present embodiment, the entire surface of the reflector 20 is silver-plated.

The decorative portion 22 is in a ring shape centering on the rotation axis L. The decorative portion 22 extends inward from the peripheral wall 31 of the operation knob 30 in the radial direction. The decorative portion 22 is exposed to a front surface of the operation device 10. A front surface 22*a* of the decorative portion 22, along with a front panel 62*a* of a panel 62 of a cover 60 (described later), configures a front surface 10*a* of the operation device 10. In this embodiment, as descried above, the entire surface of the reflector 20 is silver-plated. Accordingly, in the front surface 10*a* of the operation device 10, a ring-shaped portion surrounding the rotation axis L and configured with the front surface 22*a* of the decorative portion 22 is decorated with silver-plating. The front surface 22*a* of the decorative portion 22 serves as a decorative surface decorating the operation device 10.

A rearward protruding locked portion 23 is provided to a rear surface of the decorative portion 22. A locking tab 23*a* is provided at a rear end of the locked portion 23, the locking tab 23*a* protruding outward in a radial direction. The locking tab 23*a* has a shape that enables latching onto the lock 33 of the operation knob 30. Due to latching between the locking tab 23*a* and the lock 33, the decorative portion 22, and hence the reflector 20, is connected to the operation knob 30 so as to be integrally rotatable. Specifically, the locking tab 23*a* is in contact with a rear end portion of the lock 33 from the rear side. This contact prevents the reflector 20 from dropping off frontward. Further, a connection structure between the reflector 20 and the operation knob 30 is not limited to this. For example, the reflector 20 and the operation knob 30 may be mutually integrally formed by double molding or the like.

The reflecting portion 24 extends rearward from a rear surface of an inner peripheral edge 22*b* of the decorative portion 22. The reflecting portion 24 is provided inside the peripheral wall 31 of the operation knob 30. The reflecting portion 24 faces the illuminated portion 32. An outer surface 24*a* of the reflecting portion 24 configures a reflection surface that reflects the light from the LED 40. The shape of the outer surface 24*a* is set such that the light emitted forward from the LED 40 is reflected by the outer surface 24*a* and the reflected light travels toward the illuminated portion 32. Specifically, the reflecting portion 24 has a shape centering on the rotation axis L and having a diameter increasing toward the front side. In the present embodiment, the reflecting portion 24 has a circular truncated cone shape having a hollow therein. The outer surface 24*a* of the reflecting portion 24 configuring the reflection surface extends in a circumferential direction centering on the rotation axis L and has a diameter conically increasing toward the front side.

As described above, the light from the LED 40 is reflected by the outer surface 24*a* of the reflecting portion 24. This reflected light travels to the illuminated portion 32 and illuminates the illuminated portion 32. In this embodiment, the outer surface 24*a* of the reflecting portion 24 has a circular truncated cone shape and extends in the circumferential direction centering on the rotation axis L, on which the LED 40 is provided. Therefore, the light from the LED 40 is uniformly reflected in the circumferential direction by the outer surface 24*a* of the reflecting portion 24. As a result, the illuminated portion 32 is uniformly illuminated in the circumferential direction by the light from the LED 40. In addition, in the present embodiment, the entire surface of the reflector 20 is silver-plated as described above. Therefore, the light from the LED 40 is reflected to the illuminated portion 32 by the silver-plated surface with high reflectance.

The latching portion 26 has a cylindrical shape centering on the rotation axis L. The latching portion 26 extends rearward from the back end of the reflecting portion 24. The latching portion 26 and a tab 64*a* (described later) of the cover 60 latch onto each other. Due to this latching, the cover 60 is fixated to the reflector 20.

The cover 60 covers an opening on a front side of the operation knob 30. The cover 60 has the panel 62 and a latched portion 64, the panel 62 having a circular plate shape centering on the rotation axis L. The panel 62 extends parallel to the panel 1. The latched portion 64 extends rearward from a rear surface of the panel 62.

The panel 62 is mounted inside the decorative portion 22. An outer peripheral edge of the panel is in contact with an inner peripheral edge of the decorative portion 22. The panel 62 covers, from the front side, the reflecting portion 24 and the latching portion 26 of the reflector 20 provided on the rear side of the decorative portion 22. A central portion of the opening on the front side of the operation knob 30 is covered by the panel 62. An outer peripheral portion of the opening on the front side of the operation knob 30 is covered by the decorative portion 22. Accordingly, the front surface 62*a* of the panel 62 and the front surface 22*a* of the decorative portion 22 configure the front surface 10*a* of the operation device 10. The front surface 10*a* of the operation device 10 is exposed to the front surface of the operation device 10.

The latched portion 64 has a substantially cylindrical shape centering on the rotation axis L. The latched portion 64 extends rearward from the rear surface of the panel 62. The tab 64*a* is provided to a rear end portion of the latched portion 64, the tab 64*a* protruding outward in the radial direction. The tab 64*a* and the latching portion 26 of the reflector 20 latch onto each other. Due to this latching, the latched portion 64 is fixated to the reflector 20. Specifically, the tab 64*a* is in contact with the rear end portion of the latched portion 64 from the rear side. This contact prevents the latched portion 64, as well as the cover 60, from dropping off frontward.

In the operation device 10 configured as described above, the light emitted frontward from the LED 40 is reflected by the outer surface 24*a* of the reflecting portion 24 of the reflector 20. The reflected light travels outward in the radial direction and illuminates the illuminated portion 32 of the peripheral wall 31 of the operation knob 30. Thereby, an entire periphery of the peripheral wall 31 of the operation knob 30 is illuminated. In other words, an outer periphery of the operation device 10 is illuminated. In particular, in the operation device 10, the outer surface 24*a* of the reflecting portion 24 that acts as a reflection surface expands in the circumferential direction centering on the rotation axis L of the operation knob 30. The LED 40 is provided on the rotation axis L. Accordingly, the light from the LED 40 uniformly illuminates the illuminated portion 32. In addition, the outer surface 24*a* of the operation device 10 is silver-plated. Thus, the illuminated portion 32 is illuminated with high illuminance. Further, the front surface 22*a* of the decorative portion 22 is exposed to the front side of the operation device 10 and configures a portion of the front surface 10*a* of the operation device 10. Thus, the silver-plated front surface 22*a* of the decorative portion 22 decorates the front surface 10*a* of the operation device 10, enhancing design of the operation device 10. In this way, in the operation device 10, the reflector 20 acts as a reflecting member reflecting the light of the LED 40 to the illuminated portion 32 and also as a decorating member decorating the operation device 10 by being exposed to the front side of the operation device 10.

Figure 3:
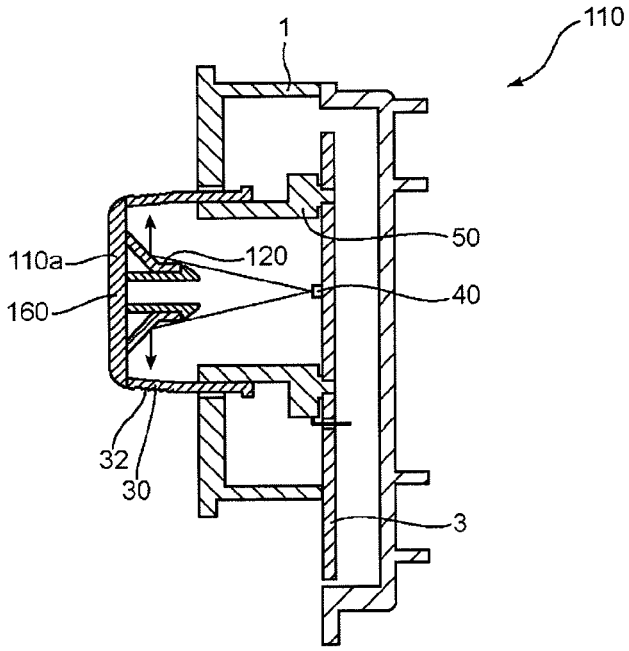
[FIG. 3] A cross-sectional view of an operation device according to another embodiment of the present invention.

Herein, the reflector may not be exposed to the front side of the operation device, and accordingly, the function of the reflector as the decorating member may be omitted. For example, as shown in FIG. 3, the decorative portion 22 of a reflector 120 may be omitted. Accordingly, a front surface 110*a* of an operation device 110 may be configured with a cover 160 only. However, when a portion of the reflector 120 is exposed to a front side of the operation device 110 to act as a decorating member of the operation device 110, such a configuration has a simple structure compared with the configuration in which a decorating member is separately provided.

Figure 4:
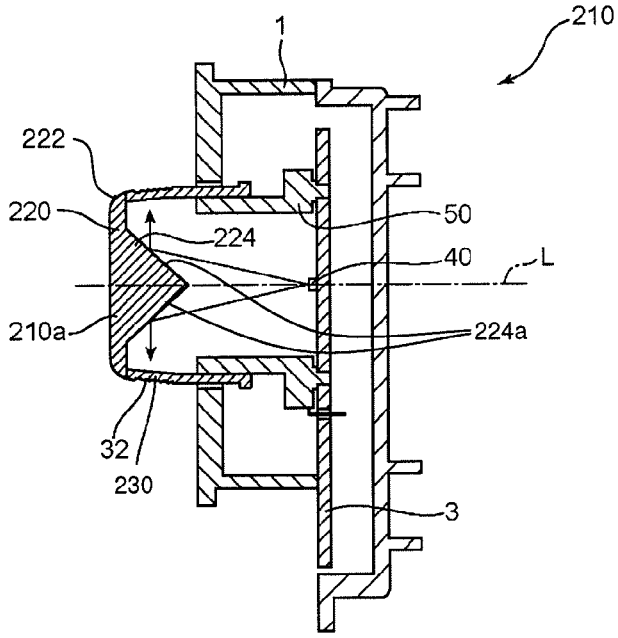
[FIG. 4] A cross-sectional view of an operation device according to another embodiment of the present invention.
Figure 5:
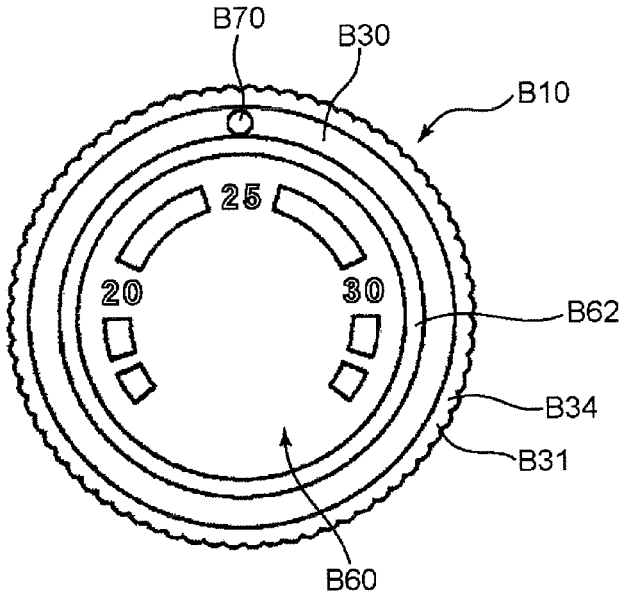
[FIG. 5] A front view of a conventional operation device.
Figure 6:
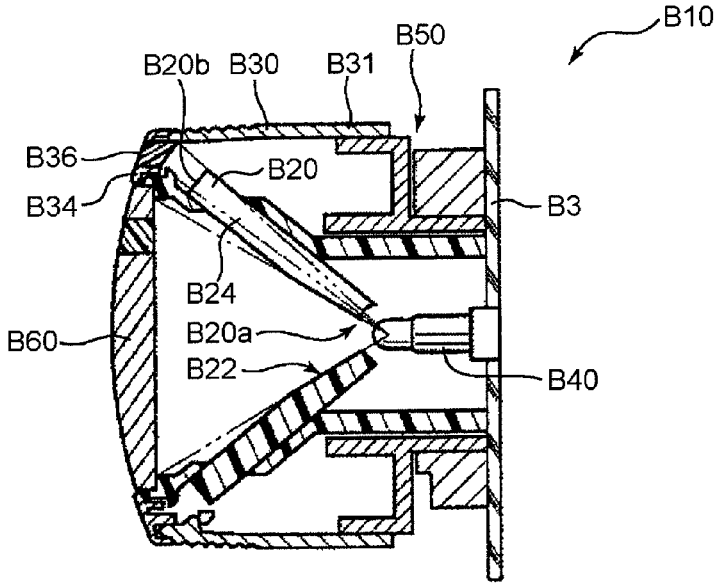
[FIG. 6] A cross-sectional view of FIG. 5.

Further, the cover 60 may be omitted. For example, a reflector 220 may have a shape shown in FIG. 4. In the reflector 220, a decorative portion 222 has a circular plate shape. In addition, the reflector 220 covers an entire opening on a front side of an operation knob 230. In this configuration, the decorative portion 222 of the reflector 220 can decorate an entire front surface 210*a* of an operation device 210. Moreover, in this configuration, the latching portion 26 that latches onto the cover 60 can be omitted. Accordingly, a reflection surface 224*a* configuring a reflecting portion 224 has a cone shape having a vertex on the rotation axis L of the operation knob 30. Therefore, the configuration of the reflector 220 is simplified.

Further, plating of the reflector 20 is not limited to silver-plating. In addition, the plating can be omitted. However, in a configuration in which the entire surface of the reflector 20 is plated, a light reflectance at a reflection surface is increased, and the illuminated portion 32 of the operation knob 30 is illuminated with higher illuminance. In addition, design of the decorative portion 22 is enhanced, which enhances design of the entire operation device 10.

A specific shape of the decorative portion 22 of the reflector 20 is not limited to the above-described shape. For example, as described above, the decorative portion 22 may have a circular plate shape that covers the entire opening of the operation knob 30. Further, the decorative portion 22 may have a shape that covers only a portion in the circumferential direction of the opening on the front side of the operation knob 30.

A specific configuration of the illuminated portion 32 of the operation knob 30 is not limited to the above-described configuration, as long as the illuminated portion 32 is provided in the circumferential direction of the peripheral wall 31 of the operation knob 30. In other words, the illuminated portion 32 may not be provided. For example, the illuminated portion 32 may have a shape that extends along the peripheral wall 31 and may be provided only in an area within a predetermined angle in the circumferential direction of the peripheral wall 31. Further, the illuminated portion 32 may be intermittently provided in the circumferential direction of the peripheral wall 31. In addition, a specific shape of the reflecting portion 24 of the reflector 20 is not limited to the above-described shape. For example, the reflecting portion 24 may have a shape that configures only a portion of a cone centering on the rotation axis L, corresponding to the illuminated portion 32 provided only in an area within a predetermined angle in the circumferential direction of the peripheral wall 31. Moreover, a position of the reflecting portion 24 may be any position as long as the position allows the reflecting portion 24 to reflect the light from the LED 40 to the illuminated portion 32. Accordingly, the reflecting portion 24 may be provided in a position that is displaced toward a LED 40 side from a position facing the illuminated portion 32.

The operation knob 30 does not have to rotationally operate the rotary encoder element 50 as long as the operation knob 30 rotates in response to a rotational operation.

Application of the operation device 10 is not limited to a means that controls the temperature of the air conditioner.

As described above, the present invention provides an operation device including an operation knob having a substantially cylindrical peripheral wall centering on an axis extending in a front-rear direction and rotating around the axis in response to a rotational operation, the peripheral wall being provided with an illuminated portion in a circumferential direction; an illumination light source provided on a rear side of the illuminated portion on an axis line of the operation knob and emitting light frontward; and a reflector provided on a front side of the illumination light source and connected to the operation knob. A surface of the reflector includes a reflection surface provided on an inner side of the peripheral wall of the operation knob and capable of reflecting the light from the illumination light source. The reflection surface has a shape extending in the circumferential direction centering on the axis line of the operation knob and having a diameter increasing toward the front side such that the light emitted frontward from the illumination light source is reflected by the reflection surface toward the illuminated portion.

In this device, the reflection surface of the reflector reflects the light from the illumination light source. Then, the reflected light reaches and illuminates the illuminated portion provided on the peripheral wall of the operation knob. In this device, the illumination light source is provided on the axis line of the operation knob. In addition, the reflection surface extends in the circumferential direction centering on the axis line. Thus, the reflection surface uniformly reflects the light from the illumination light source around the axis line of the operation knob, in other words, in the circumferential direction of the peripheral wall of the operation knob. Thereby, the illuminated portion is more uniformly illuminated. Moreover, in this device, the surface of the reflector reflects the light from the illumination light source. Therefore, it is not necessary to increase the thickness of the reflector. In other words, compared with a device, such as in the Patent Literature 1, in which a light guiding body is employed to guide light from the illumination light source to the peripheral wall of the operation knob and the light passes through inside the wall of the light guiding body, the reflector of the present device is thinner, the reflector being a member guiding the light from the illumination light source to the peripheral wall of the operation knob. This results in lighter weight of the entire device and a reduction in cost.

In the present invention, the entire surface of the reflector is plated, and a portion of the plated surface of the reflector configures the reflection surface that reflects the light from the illumination light source. It is preferable that at least a portion of the plated surface of the reflector other than a portion configuring the reflection surface is exposed to a front surface of the operation device to configure a decorative surface.

In this configuration, the reflection surface is plated. Thereby, a reflectance on the reflection surface is improved, which results in improved illuminance at the illuminated portion. In addition, in this configuration, the decorative surface that is a portion of the plated surface of the reflector is exposed to the front surface of the operation device. Thus, this decorative surface decorates the front surface of the operation device by plating. Accordingly, the reflector acts as a reflecting member reflecting the light from the illumination light source as well as a decorating member decorating the operation device by plating. This simplifies the configuration of the device compared with a case in which these components are separately provided.

Examples of the illuminated portion includes a component having a shape extending in the circumferential direction of the peripheral wall of the operation knob.

Further, in the present invention, the illuminated portion has a shape extending over an entire periphery of the peripheral wall of the operation knob. The reflector includes a reflection portion provided on the inner side of the operation knob and extending over the entire periphery in the circumferential direction centering on the axis line of the operation knob; and a substantially ring-shaped decorative portion centering on the axis line of the operation knob and extending in a direction substantially orthogonal to the axis line, the decorative portion being provided at a front end of the reflection portion and being connected to a front end of the operation knob. A cover covering the reflection member is attached on an inner side of the decorative portion of the reflector. A portion of the surface of the reflection portion of the reflector configures the reflection surface while the substantially ring-shaped front surface of the decorative portion of the reflector configures the decorative surface.

In this configuration, the reflection surface included in the surface of the reflection portion of the reflector reflects the light from the illumination light source to the illuminated portion. Then, along with the cover, the decorative surface configured by the front surface of the decorative portion of the reflector configures the front surface of the operation device. Thus, while illumination over the entire periphery of the operation knob is provided, a substantially ring-shaped decoration is provided on the operation device.

A specific shape of the reflection portion of the reflector includes a cone centering on the axis line of the operation knob and having a diameter increasing toward the front side.

The invention claimed is:

1. An operation device, comprising:

an operation knob having a substantially cylindrical peripheral wall centering on an axis extending in a front-rear direction and rotating around the axis in response to a rotational operation, the peripheral wall being provided with an illuminated portion in a circumferential direction;

an illumination light source provided rearward of the illuminated portion on an axis line of the operation knob and emitting light frontward; and a reflector provided forward of the illumination light source and connected to the operation knob, wherein a surface of the reflector includes a reflection surface provided inward of the peripheral wall of the operation knob and configured to reflect the light from the illumination light source; and the reflection surface has a shape extending in the circumferential direction centering on the axis line of the operation knob and having a diameter increasing toward a front side such that the light emitted frontward from the illumination light source is reflected by the reflection surface toward the illuminated portion.

2. The operation device according to claim 1, wherein an entire surface of the reflector is plated;

a portion of the plated surface of the reflector configures the reflection surface that reflects the light from the illumination light source; and at least a portion of the plated surface of the reflector, other than a portion configuring the reflection surface, configures a decorative surface exposed to a front surface of the operation device.

3. The operation device according to claim 2, wherein the illuminated portion has a shape extending in the circumferential direction of the peripheral wall of the operation knob.

4. The operation device according to claim 3, wherein the illuminated portion has a shape extending over an entire periphery of the peripheral wall of the operation knob;

the reflector includes a reflection portion provided inward of the operation knob and extending over the entire periphery in the circumferential direction centering on the axis line of the operation knob, and a substantially ring-shaped decorative portion centering on the axis line of the operation knob and extending in a direction substantially orthogonal to the axis line, the decorative portion being provided at a front end of the reflection portion and being connected to a front end of the operation knob;

a cover covering the reflection member is attached on an inner side of the decorative portion of the reflector; and a portion of the surface of the reflection portion of the reflector configures the reflection surface while the substantially ring-shaped front surface of the decorative portion of the reflector configures the decorative surface.

5. The operation portion according to claim 4, wherein the reflection portion of the reflector has a cone shape centering on the axis line of the operation knob and having a diameter increasing toward the front side.

* * * * *